United States Patent [19]

Olson et al.

[11] Patent Number: 4,860,985

[45] Date of Patent: Aug. 29, 1989

[54] BRACKET ASSEMBLY FOR SUPPORTING A TRAFFIC SIGN

[75] Inventors: Raylin J. Olson, Loves Park; Lawrence L. Prunty; Wendell W. Whitehead, both of Rockford, all of Ill.

[73] Assignee: Olson Pattern & Foundry Works, Inc., Rockford, Ill.

[21] Appl. No.: 244,020

[22] Filed: Sep. 14, 1988

[51] Int. Cl.[4] ..... A47H 1/10

[52] U.S. Cl. ..... 248/229; 248/214; 248/219.4; 248/231

[58] Field of Search ..... 248/347, 219.4, 278, 248/214, 231, 230, 229; 340/119; 116/63 R; 362/431

[56] References Cited

U.S. PATENT DOCUMENTS

| | | | |
|---|---|---|---|
| 1,053,684 | 2/1913 | Vogel | 24/278 |
| 3,245,642 | 4/1966 | Dicke | 248/230 X |
| 3,854,685 | 12/1974 | Parduhn | 248/214 |
| 3,917,205 | 11/1975 | Meadors | 248/229 |
| 4,489,910 | 12/1984 | Ferguson | 362/431 X |
| 4,659,046 | 4/1987 | Parduhn | 248/231 |

*Primary Examiner*—J. Franklin Foss

*Attorney, Agent, or Firm*—Leydig, Voit & Mayer

[57] ABSTRACT

An electric traffic signal is supported from a horizontal mast by a bracket assembly comprising (1) upper and lower signal-supporting bracket arms located at the upper and lower ends of a vertical tube, (2) a swivel supporting the tube for vertical and angular adjustment and (3) a saddle pivotally supporting the swivel and adapted to be attached to the mast by a pair of clamping bands. Pressure plates are located in the saddle and are adapted to be adjusted to take up the slack in the bands and thereby cinch the bands tightly around the mast. Conventional muffler clamps are used to attach the bracket arms to the tube and to attach the tube to the swivel. A cylindrical rod made of elastomeric material closes an elongated slot in the rear of the tube, the slot enabling electrical leads for the traffic signal to be threaded into the tube.

9 Claims, 3 Drawing Sheets

91
38
36
37
30
32
34
33
35
13
16
15
60
66
7
20
12
61
48
53
80
24
21
51
63
27
26
23
49
54
10
18
22
25
28
45
42
31
39
40
43
41
44
14
11
3

BRACKET ASSEMBLY FOR SUPPORTING A TRAFFIC SIGN

BACKGROUND OF THE INVENTION

This invention relates to a bracket assembly and, more particularly, to a bracket assembly for attaching a traffic sign such as an electric traffic signal to an elongated mast. Bracket assemblies for traffic signs are disclosed in Parduhn U.S. Pat. Nos. 3,586,280; 3,764,099; 3,854,685 and 4,659,046.

It is conventional for the bracket assembly to be attached to the mast by flexible straps or bands adapted to be tightened around the mast. A typical band which is used is that sold under the trade designation BAND-IT by Houdaille Industries, Inc. In prior bracket assemblies having such bands, tightening of the bands is effected by a special tool which acts directly on the end portions of the bands. The end portions of the band are held in secured relation with one another by a buckle after the band has been tightened. Bands of this type are somewhat difficult to install, require a special installation tool, and do not lend themselves to quick and easy adjustment.

The traffic signal usually is supported by bracket arms which are secured to the end portions of an elongated tube. The tube, in turn, is adjustably secured to a swivel which is connected to the mast by means of a saddle. Prior arrangements for connecting the brackets to the tube and for connecting the tube to the swivel are relatively expensive.

When an electrical sign is supported by the bracket assembly, electrical leads extend from the mast through the saddle and the swivel and then extend within the tube to one of the bracket arms for connection to the traffic signal. It is necessary to seal the tube against water and, in prior arrangements, difficulty is encountered in establishing a seal in all of the various adjusted positions of the tube.

SUMMARY OF THE INVENTION

One of the objects of the present invention is to provide a new and improved bracket assembly in which the flexible bands for attaching the bracket assembly to the mast may be tightened and adjusted in a manner which enables quicker and easier installation of the bracket assembly on the mast than has been possible heretofore.

A more detailed object is to achieve the foregoing through the provision of a bracket assembly having unique pressure plates for taking slack out of the bands and cinching the bands tightly around the mast after the ends of the bands have been fastened together.

Still another object of the invention is to reduce the cost of the bracket assembly by using conventional muffler clamps for securing the bracket arms adjustably to the tube and for securing the tube adjustably to the swivel.

The invention also resides in the use of an elongated cylindrical rod of elastomeric material for sealing the tube and shielding the electrical leads of the traffic signal against exposure to water.

These and other objects and advantages of the invention will become more apparent from the following detailed description when taken in conjunction with the accompanying drawings.

DETAILED DESCRIPTION OF THE PREFERRED EMBODIMENT

Figures 1, 2:
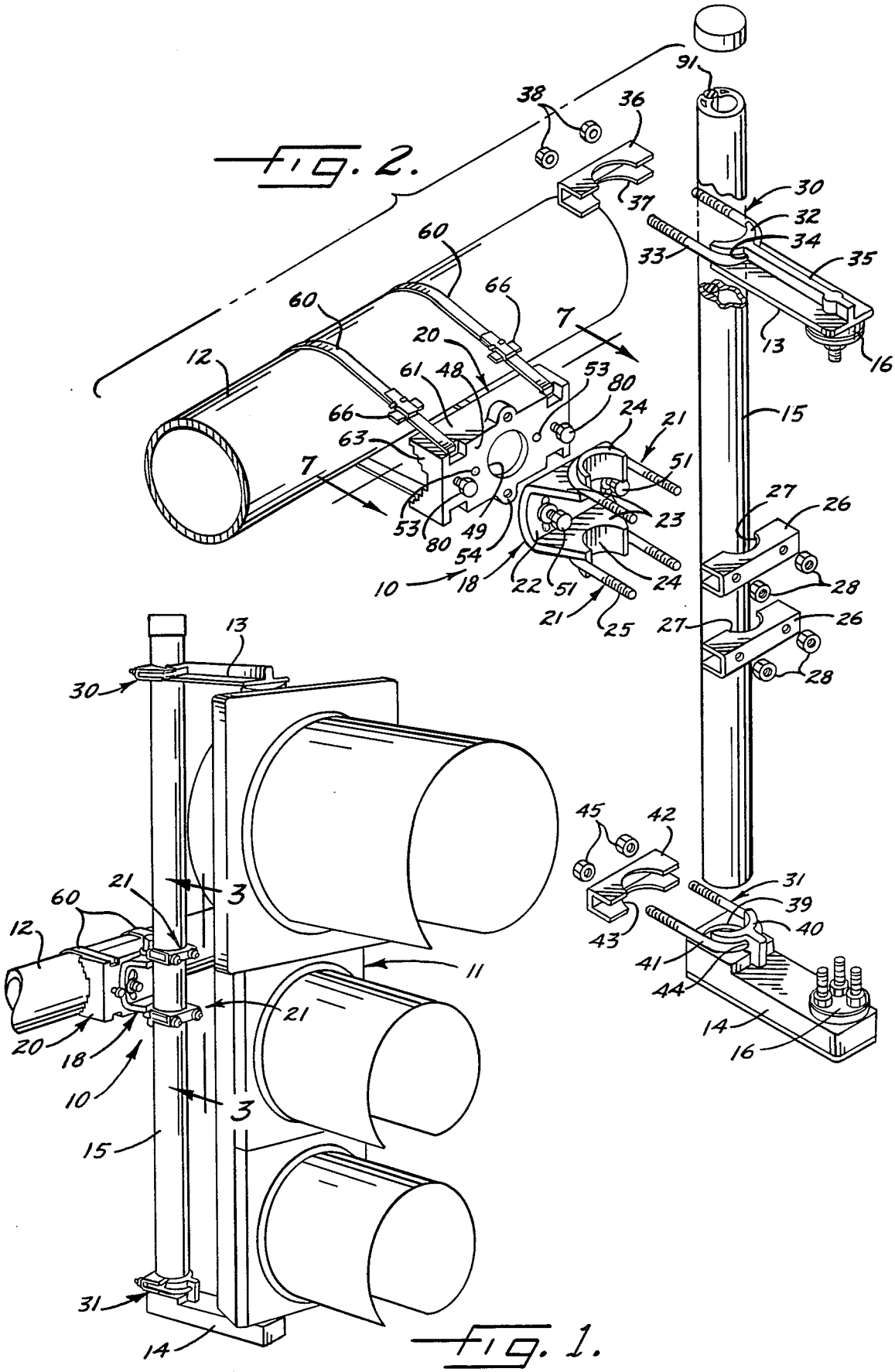
FIG. 1 is a perspective view of a typical traffic signal supported from an elongated mast by a new and improved bracket assembly incorporating the unique features of the present invention.
FIG. 2 is an enlarged exploded perspective view of the bracket assembly shown in FIG. 1.

For purposes of illustration, the invention has been shown in the drawings as embodied in a bracket assembly 10 for securing a traffic sign such as an electric traffic signal 11 to an elongated mast 12. In this instance, the mast is cylindrical and extends horizontally from a vertical pole (not shown). It will be appreciated that the mast could be positioned vertically or could be disposed at a selected angle between horizontal and vertical.

The traffic signal 11 itself is of conventional construction and is adapted to be supported by upper and lower bracket arms 13 and 14 which are fastened to the upper and lower end portions of an elongated cylindrical tube 15. Conventional fittings 16 (FIG. 2) on the lower side of the upper arm 13 and the upper side of the lower arm 14 serve to connect the signal 11 to the arms. In the present instance, the tube 15 extends generally vertically and is generally perpendicular to the horizontal mast 12 so as to locate the traffic signal in an upright position.

Figure 3:
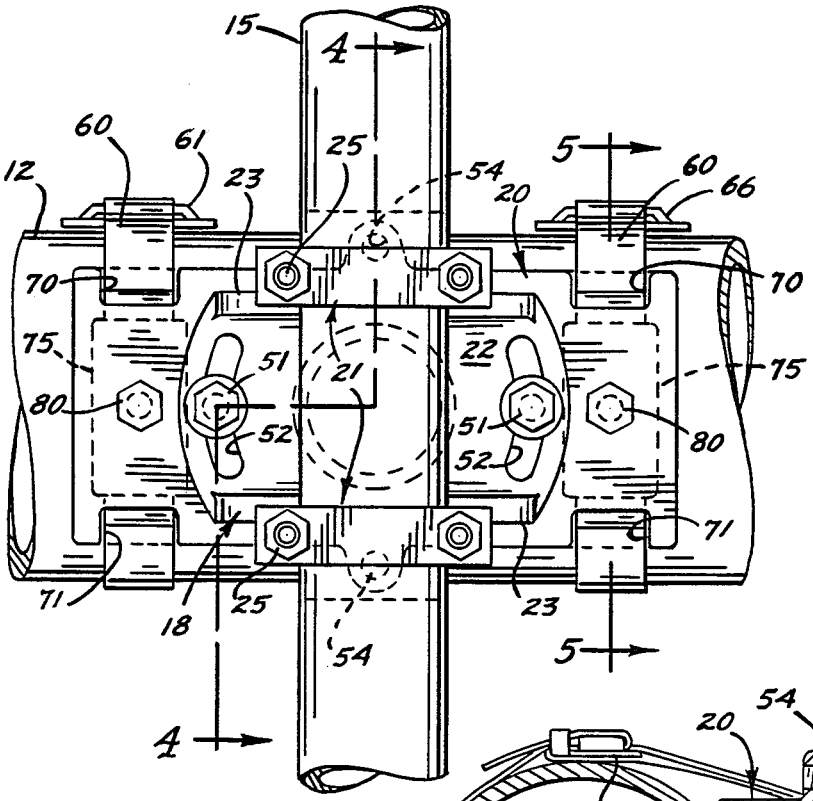
FIG. 3 is an enlarged fragmentary front elevational view showing the swivel and the saddle of the bracket assembly and showing the saddle anchored to the mast by a pair of flexible bands.
Figure 4:
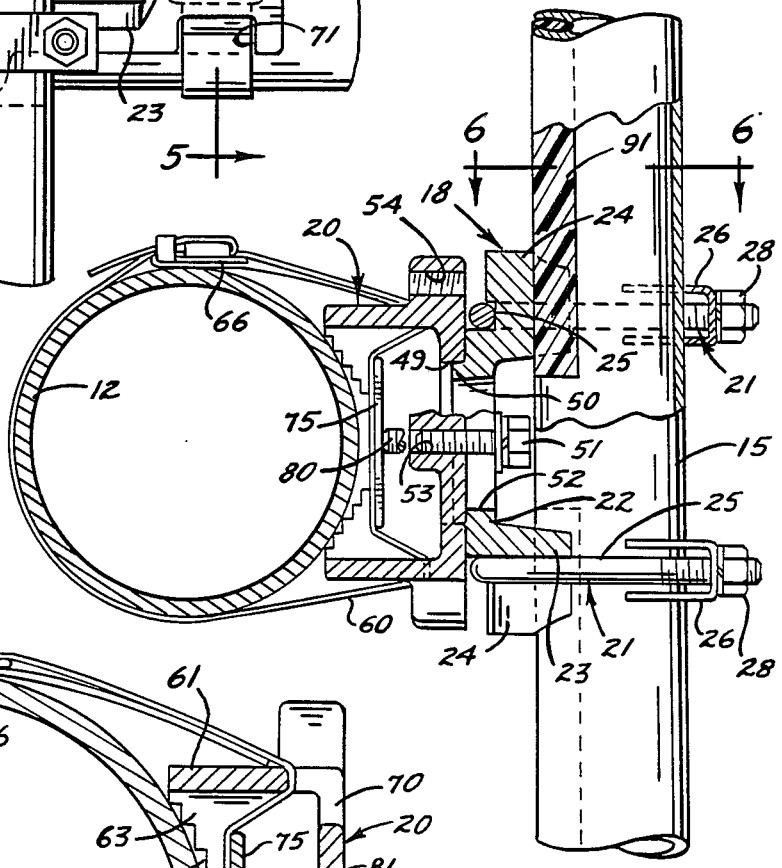
FIG. 4 is a fragmentary cross-section taken substantially along the line 4—4 of FIG. 3.

As shown in FIGS. 2 to 4, the tube 15 is attached to a swivel 18 which, in turn, is attached to a saddle 20 adapted to be connected to the mast 12. In accordance with one aspect of the invention, the tube 15 is connected to the swivel 18 by two conventional muffler clamps 21 which are very low in cost. The swivel 18 is a generally U-shaped aluminum casting defined by an upright rear plate 22 (FIG. 4) and by upper and lower horizontal plates 23 which project forwardly from the rear plate. To enable use of the muffler clamps 21, generally arcuate cradles 24 are formed integrally with the plates 23 and extend upwardly from the upper plate and downwardly from the lower plate. The cradles 24 are formed on the same radius as the tube 15 and embrace the tube adjacent the midportion thereof.

Each muffler clamp 21 comprises a U-bolt 25 having a pair of threaded legs. The U-bolts are looped around the cradles 24 on the swivel 18 and are positioned with their legs straddling the tube 15. Clamping members 26 are supported by the U-bolts and are formed with arcuate pockets 27 which receive the tube 15. When nuts 28 on the legs of the U-bolts 25 are tightened, the tube 15 becomes clamped between the cradles 24 and the clamping members 26.

Muffler clamps 30 and 31 (FIGS. 2 and 4) are used to attach the upper and lower bracket arms 13 and 14, respectively, to the tube 15. The rear end portion of the upper bracket arm 13 is formed with an arcuate cradle 32 which receives the upper end portion of the tube. The muffler clamp 30 includes a U-bolt 33 which is looped around the cradle 32 and extends through a hole 34 formed at the junction of the cradle and a reinforcing rib 35 on the upper side of the bracket arm 13. Threaded legs of the U-bolt 33 serve to support a clamping member 36 having an arcuate pocket 37 which receives the tube 15. When nuts 38 are tightened on the legs of the U-bolt 33, the cradle 32 and the clamping member 36 are drawn toward one another and into tight gripping engagement with the tube 15.

The lower bracket arm 14 is formed with a socket 39 (FIG. 2) which telescopically receives the lower end portion of the tube 15 and also is formed with an upwardly projecting arcuate cradle 40 which embraces the tube. The muffler clamp 31 includes a U-bolt 41 with threaded legs and further includes a clamping member 42 with an arcuate pocket 43. The U-bolt extends through a hole 44 adjacent the cradle 40. Nuts 45 are adapted to be threaded onto the legs of the U-bolt 41 and, when tightened, cause the cradle 40 and the clamping member 42 to draw into clamping engagement with the tube 15.

As a result of the clamp 30, the upper bracket arm 13 may be adjusted upwardly and downwardly on the tube 15 as necessary to accommodate the particular height of the traffic signal 11. The clamps 21 enable the tube 15 to be adjusted vertically on the swivel 18 so as to enable the traffic signal to be located at a selected elevation.

Figure 7:
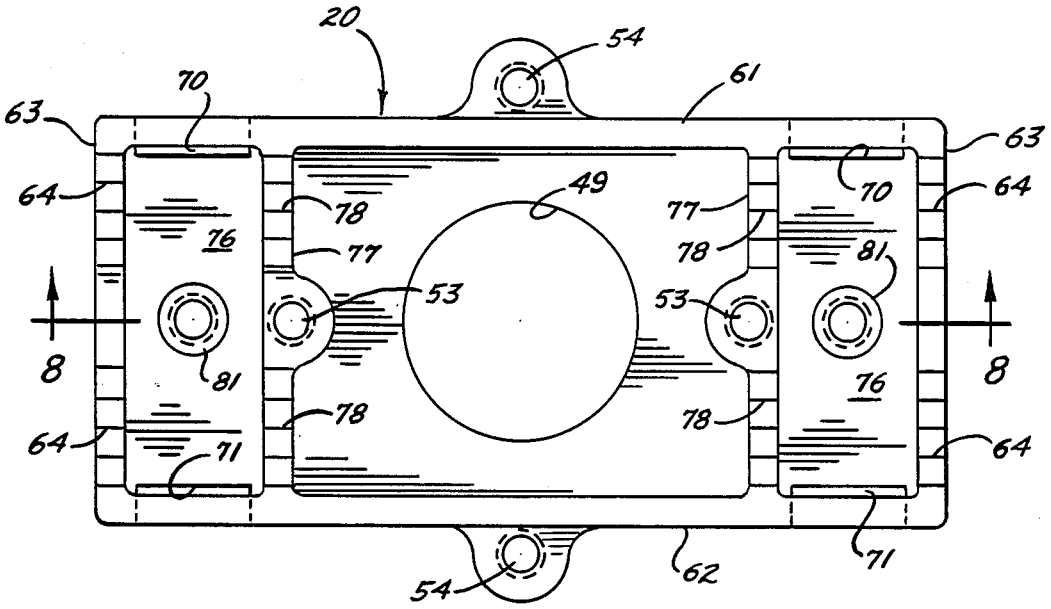
FIG. 7 is an enlarged cross-section taken substantially along the line 7—7 of FIG. 2.

In the present instance, the saddle 20 also is an aluminum casting and its front side 48 (FIG. 2) is formed with a circular hole 49 for receiving a tubular boss 50 (FIG. 4) formed integrally with and projecting rearwardly from the swivel 18. The swivel 18 thus is capable of turning relative to the saddle 20 about the axis of the boss 50 so as to enable the tube 15 and the traffic signal 11 to be positioned at different angular orientations. In order to hold the signal at a selected orientation, screws 51 (FIG. 3) extend through two arcuate slots 52 formed in the swivel 18 and are threaded into diametrically spaced holes 53 in the front side 48 of the saddle 20. The slots 52 enable the swivel 18 to be turned through a limited range (e.g., 55 degrees) relative to the saddle 20 and thus enable the traffic signal 11 to be positioned at different angular orientations. Further adjustment is enabled by an additional pair of threaded holes 54 (FIGS. 2 and 7) formed in the front side 48 of the saddle 20 and spaced ninety degrees from the holes 53. By threading the screws 51 into the holes 54 rather than the holes 53, the swivel 18 may be positioned so as to cause the tube 15 to extend generally parallel to the mast 12 instead of generally perpendicular to the mast.

In accordance with the primary aspect of the invention, the saddle 20 is connected to the mast 12 by a pair of flexible bands 60 and is uniquely constructed to enable the bands to be tightened quickly and easily around the mast without the use of special tools. By virtue of the manner in which the bands are tightened, the bracket assembly 10 may be installed on the mast 12 faster and easier than has been possible heretofore.

More specifically, the saddle 20 is of generally U-shaped cross-section and is positioned with the open side of the U facing rearwardly toward the mast 12 (see FIG. 4). In addition to the front side 48, the saddle includes upper and lower horizontal sides 61 and 62 formed integrally with and projecting rearwardly from the front side. End walls 63 are located at the ends of the walls 48, 61 and 62 and are formed with rearwardly opening notches 64 which are sized and shaped to conform generally to the size and shape of the mast 12. As a result, the rear side of the saddle 20 defines a concave seat for receiving the mast 12. The edges of the notches 64 preferably are serrated to enable the saddle to dig into the mast and to enable the saddle to be used with masts of different diameter.

Figure 5:
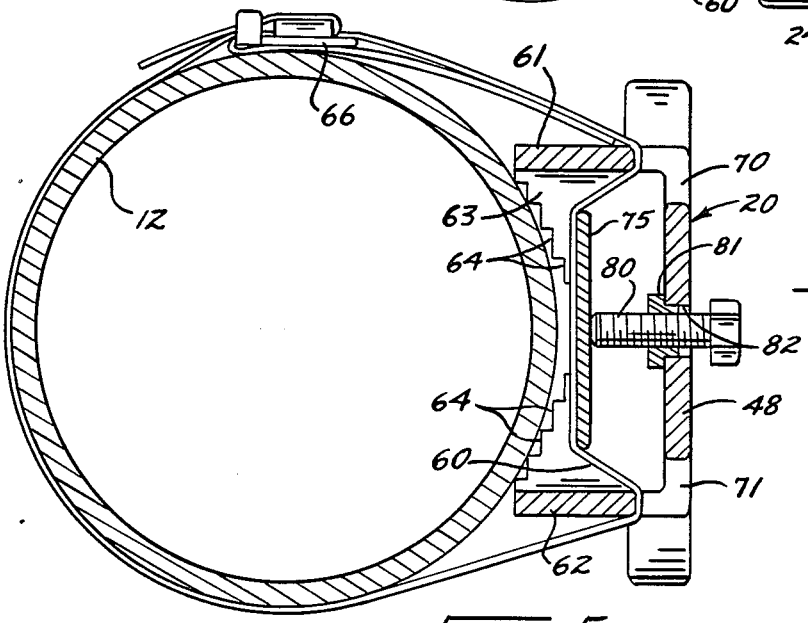
FIG. 5 is an enlarged cross-section taken substantially along the line 5—5 of FIG. 3.

While the bands 60 may be of any appropriate construction, the bands which preferably are used herein are those sold under the trade designation BAND-IT by Houdaille Industries, Inc. Each band is in the form of a flexible steel strap. When the band is formed into a loop, its two end portions overlap one another and are adapted to be secured together by a buckle 66 (FIG. 5). The two bands are spaced from one another along the length of the mast 12.

Pursuant o the invention, the bands 60 extend through vertically aligned upper and lower eyes 70 and 71 (FIGS. 5 and 7) formed in the saddle 20, there being two pairs of eyes spaced from one another along the length of the saddle. The upper eyes 70 of each pair are defined by slots formed through the saddle 20 at the junction of the front side 48 of the saddle with the upper side 61 thereof. Similarly, the lower eyes 71 of each pair are defined by slots formed through the saddle at the junction of the front side 48 and the lower side 62. The bands 60 are threaded through the eyes 70 and 71 and their end portions are fastened loosely together by the buckles 66 before the bracket assembly 10 is shipped from the manufacturing plant.

Figure 8:
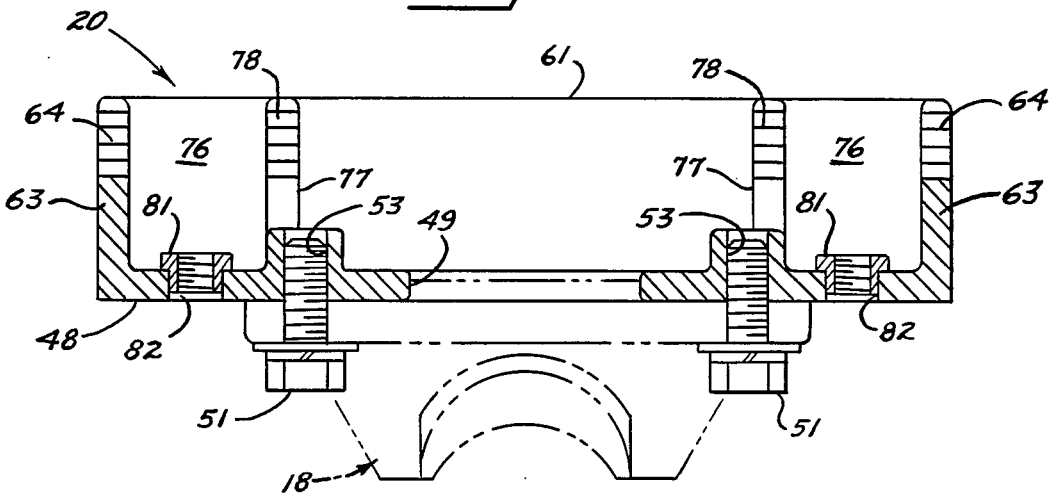
FIG. 8 is a cross-section taken substantially along the line 8—8 of FIG. 7.

Further in carrying out the invention, final tightening of the bands 60 is effected by adjustable pressure plates 75 (FIG. 5) located within the saddle 20, there being one pressure plate for each band. In the present instance, each pressure plate is simply a rectangular wafer of metal which engages the rear side of the respective band and which initially is captivated loosely in a pocket 76 (FIGS. 8 and 9) formed in the saddle 20. The sides of each pocket are defined by the adjacent end wall 63 and by an intermediate wall 77 which projects rearwardly from the front side 48 of the saddle. The rear edge of each intermediate wall 77 is notched at 78 in the same manner as the end walls 63 for purposes of accommodating the mast 12. When the bracket assembly 10 is shipped, the bands 60 prevent the pressure plates 75 from falling rearwardly out of the pockets 76.

In order to adjust the pressure plates 75 for purposes of tightening the bands 60, screws 80 (FIG. 5) extend through the front side 48 of the saddle 20 and into the pockets 76. Each screw is threaded through a nut 81 which is suitably held against turning in a hole 82 in the front side 48 of the saddle 20.

With the foregoing arrangement, the saddle 20 is installed on the mast 12 by slipping the loosely buckled bands 60 onto the mast and moving the saddle along the mast to the desired lengthwise position. Each band 60 then is tightened by hand and is secured by the buckle 66 when the band is sufficiently tight to stabilize the saddle 20 and prevent the saddle from turning on the mast 12 under its own weight. Thereafter, the screws 80 are tightened in order to force the pressure plates 75 rearwardly against the bands 60 and to draw the bands into the saddle 20 through the eyes 70 and 71. As the screws 80 are tightened, the plates 75 take up the slack in the bands 60 and thereby cinch the bands tightly around the mast 12 in order to anchor the saddle 20 to the mast. By virtue of the plates 75 and the screws 80, the saddle 20 may be installed easily and without need of using a special tool to tighten the bands. Also, the screws 80 may be loosened and the saddle 20 may be easily re-positioned on the mast 12 if it is necessary to make final adjustments to the position of the traffic signal 11 or if it later becomes desirable to locate the signal in a different position on the mast.

The electrical leads 89 (FIG. 6) for the traffic signal 11 extend from inside the mast 12 and out of a hole (not visible) in the side of the mast, through the hole 49 in the saddle 20 and the tubular boss 50 of the swivel 18, and then into the rear of the tube 15. The leads then extend downwardly within the tube 15, to and through the lower bracket arm 14 and then upwardly to the traffic signal 11. The tube 15 is an extrusion and, to enable the electrical leads to enter the rear of the tube from the swivel 18, a rearwardly opening slot 90 (FIG. 6) is defined in the rear side of the tube and extends along the length of the tube.

Figure 6:
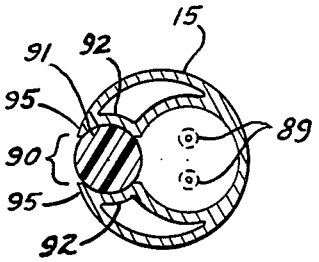
FIG. 6 is a cross-section taken along the line 6—6 of FIG. 4.

According to another feature of the invention, the slot 90 in the rear side of the tube 15 is sealed by a cylindrical rod 91 made of synthetic foam rubber or other elastomeric material. As shown in FIG. 6, the inside of the tube 15 is formed with opposing arcuate webs 92 which coact to form a concave seat for the rod 91. The seat is located immediately adjacent the slot 90. After the leads 89 have been threaded through the slot 90 and into the passage defined by tube 15, the rod 91 is cut into two pieces of appropriate length for insertion into the seat 92; one length of rod extending downwardly from the upper end of the tube to the leads 89 at the center hole 52 and the other length of rod extending downwardly from such leads to the lower end of the tube. Ribs 95 (FIG. 6) are located at the edge of the slot 90 immediately adjacent the seat 92 and prevent the rods 91 from being crushed by the cradles 24 when the clamps 21 are tightened to the swivel 18. The ribs also prevent the clamping members 36 and 42 of the clamps 30 and 31 from crushing the rods.

From the foregoing, it will be apparent that the present invention brings to the art a new and improved traffic signal bracket assembly 10 in which extremely low cost and readily available muffler clamps 21, 30 and 31 are used to fasten the tube 15 to the swivel 18 and to fasten the bracket arms 13 and 14 to the tube. Attachment of the saddle 20 to the mast 12 with the bands 60 is simplified by virtue of the pressure plates 75 which enable quick and easy tightening of the bands while permitting the bands to be easily loosened and re-tightened if necessary. The cylindrical rod 91 for closing and sealing the slot 90 in the tube 15 is relatively inexpensive and may be quickly installed.

We claim:

1. A bracket assembly adapted to support a traffic sign and adapted to be fastened to a generally cylindrical mast, said bracket assembly comprising a saddle having front and rear sides, means for attaching the traffic sign to the front side of the saddle, the rear side of the saddle being sized and shaped to conform generally to the size and shape of said mast, said saddle being generally U-shaped in cross-section with the open end of the U facing rearwardly, and means for clamping said saddle releasably to said mast, said means comprising first and second flexible clamping bands adapted to be wrapped around the mast in spaced relation from one another along the mast, first and second pairs of spaced eyes formed through said mast with one pair of eyes being spaced from the other pair in accordance with the spacing of said bands, each eye of each pair being aligned with the other eye of the pair, said first and second bands being threaded through the eyes of said first and second pairs, respectively, means for securing the end portions of each band together while permitting relative adjustment of said end portions for purposes of cinching the band loosely around said mast and clamping said saddle loosely to said mast, and means independent of said securing means for tightening said bands to cause the bands to pull the saddle toward the mast and to clamp the saddle rigidly to the mast, said tightening means comprising first and second plates disposed within said saddle and engageable with the front sides of said first and second bands, respectively, and first and second screws threaded through the front side of said saddle and engageable with said first and second plates, respectively, said screws being operable when tightened to push said plates rearwardly against said bands and cause said bands to cinch tightly around said mast and clamp said saddle tightly to said mast.

2. A bracket assembly as defined in claim 1 in which each of said plates is located in its entirely between the eyes of the respective pair of eyes.

3. A bracket assembly as defined in claim 2 further including means within said saddle defining pockets for said plates.

4. A bracket assembly as defined in claim 2 in which the front side of said saddle is generally vertical, said saddle further including generally horizontal upper and lower sides formed integrally with and projecting rearwardly from the upper and lower margins, respectively, of said front side, one eye of each pair comprising a slot formed through the saddle at the junction of said front side with one of said horizontal sides, the other eye of each pair comprising a slot formed through said saddle at the junction of said front side with the other of said horizontal sides.

5. A bracket assembly as defined in claim 1 further including a swivel secured to the front side of said saddle and adapted to be turned to and held in different angular positions relative to said saddle, an elongated cylindrical tube adapted for attachment to said traffic sign, a pair of arcuate cradles on said swivel and sized and shaped to receive said tube, said cradles being spaced from one another along the axis of said tube, U-bolts extending around said cradles and having threaded legs straddling said tube, clamps having arcuate pockets for receiving said tube, there being one clamp supported on the legs of each U-bolt, and nuts threaded onto the legs of said U-bolts and operable when tightened to cause said tube to become clamped between said cradles and said clamps.

6. A bracket assembly as defined in claim 1 further including an elongated cylindrical tube attached to said saddle and adapted for attachment to said traffic sign, said tube defining a passage for electrical leads to said sign, one side of said tube being open, an arcuate seat within said tube and located between said passage and said open side of said tube, said seat extending longitudinally of said tube, and an elongated cylindrical rod made of elastomeric material and received within said seat with a snug fit, said rod serving to seal the open side of said tube.

7. A bracket assembly as defined in claim 1 further including a swivel, means for securing said swivel to said saddle in a selected angular position, an elongated cylindrical tube adapted for attachment to the traffic sign, a pair of arcuate cradles on said swivel and sized and shaped to receive said tube, said cradles being spaced form one another long the axis of said tube, U-bolts extending around said cradles and having threaded legs straddling said tube, clamps having arcuate pockets for receiving said tube, there being one clamp supported on the legs of each U-bolt, and nuts threaded onto the legs of said U-bolts and operable when tightened to cause said tube to become clamped between said cradles and said clamps.

8. A bracket assembly as defined in claim 7 further including bracket arms adjacent the ends of said tube, means for attaching said sign to said bracket arms, each of said bracket arms having an arcuate cradle sized and shaped to receive said tube, a U-shaped bolt extending around the cradle of each bracket arm and having threaded legs straddling said tube, clamping member supported on the legs of said U-shaped bolts and having arcuate pockets for receiving said tube, and nuts threaded on the legs of said U-shaped bolts and operable when tightened to cause said tube to become clamped between said clamping members and the cradles on said bracket arms.

9. A bracket assembly as defined in claim 7 in which said tube defines a passage for electrical leads to said sign, one side of said tube being open, an arcuate seat within said tube and located between said passage and said open side of said tube, said seat extending longitudinally of said tube, and an elongated cylindrical rod made of elastomeric material and received within said seat with a snug fit, said rod serving to seal the one side of said tube.

* * * * *